US007397206B2

(12) United States Patent
Yao

(10) Patent No.: US 7,397,206 B2
(45) Date of Patent: Jul. 8, 2008

(54) PHASE SWITCH AND A STANDING WAVE LINEAR ACCELERATOR WITH THE PHASE SWITCH

(75) Inventor: Chongguo Yao, Sichuan (CN)

(73) Assignee: Mian Yang Gao Xin Qu Twin Peak Technology Development Inc. (CN)

( * ) Notice: Subject to any disclaimer, the term of this patent is extended or adjusted under 35 U.S.C. 154(b) by 50 days.

(21) Appl. No.: 11/496,733

(22) Filed: Jul. 31, 2006

(65) Prior Publication Data

US 2007/0096664 A1 May 3, 2007

Related U.S. Application Data

(63) Continuation of application No. PCT/CN2004/000502, filed on May 18, 2004.

(30) Foreign Application Priority Data

Feb. 1, 2004 (CN) ..... 2004 1 0021763

(51) Int. Cl.
*H05H 9/00* (2006.01)

(52) U.S. Cl. ..... 315/505; 315/501; 315/500

(58) Field of Classification Search ..... 315/505, 315/500–504, 506, 507; 331/79–84
See application file for complete search history.

(56) References Cited

U.S. PATENT DOCUMENTS

| | | | | |
|---|---|---|---|---|
| 4,286,192 | A | 8/1981 | Tanabe et al. | |
| 4,382,208 | A | 5/1983 | Meddaugh et al. | |
| 4,629,938 | A | 12/1986 | Whitham | |
| 4,746,839 | A * | 5/1988 | Kazusa et al. | 315/5.41 |
| 5,381,072 | A | 1/1995 | Tanabe | |
| 5,821,694 | A | 10/1998 | Young | |
| 6,316,876 | B1 | 11/2001 | Tanabe | |
| 6,366,021 | B1 | 4/2002 | Meddaugh et al. | |

FOREIGN PATENT DOCUMENTS

| | | |
|---|---|---|
| CN | 1237079 A | 12/1999 |
| JP | 63-274098 | 11/1998 |
| JP | 2000-243599 | 8/2000 |
| WO | PCT/GB00/03004 | 8/2000 |

* cited by examiner

*Primary Examiner*—Tuyet Vo
(74) *Attorney, Agent, or Firm*—Dorsey & Whitney LLP

(57) ABSTRACT

A phase switch (energy switch) comprising a three-cavity system (an end-coupled cavity+side-passed accelerate cavity+an end-coupled cavity) and a separate single couple cavity is disclosed. The phase shift between the adjacent accelerate cavities is $\pi$ when the three-cavities system is disordered (state '0'); and a microwave pass through the three-cavities system to the adjacent accelerate cavities, the phase between the adjacent accelerate cavities is change to $2\pi$ (or 0) when the single couple cavity is disordered (state '1'). When the state 0 changes to state 1, the field phase in the structure behind the system is changed to $\pi$, thereby to switch the phase. In the two states, the entire structure operates in $\pi/2$ mode, that is very stable. That is very important for the medical accelerator. The detaining components have been moved outside the cavity when the single couple cavity or the three-cavity system is in the operate state, without warring about high frequency breakdown. By changing couple between the two end-coupled cavities in the three-cavity system and the adjacent accelerate cavities and between the cavities in the system, the relative field-strength in the acceleration section besides the switching is changed while the phase reverses. It can be used for 6 Mev accelerator middle-energy or high-energy accelerator.

17 Claims, 6 Drawing Sheets field distribution in accelerator field distribution in accelerator field distribution in accelerator field distribution in accelerator

PHASE SWITCH AND A STANDING WAVE LINEAR ACCELERATOR WITH THE PHASE SWITCH

CROSS-REFERENCE TO RELATED APPLICATION(S)

This application is a continuation of International application number PCT/CN2004/000502, filed May 18, 2004 which claims priority to Chinese application No. CN 200410021763.0 filed Feb. 1, 2004, the contents of both are herein incorporated in their entirety by reference.

TECHNICAL FIELD

The invention relates to a phase switch and a standing wave electron linear accelerator formed by using the phase switch, more specifically, to a phase switch stably operating in $\pi/2$ mode and a standing wave electron linear accelerator for medical use that is formed by using the phase switch.

BACKGROUND ART

Standing wave electron linear accelerators are widely used in radiation treatment. It has been a research direction over the past thirty years to extend the operating energy range, that is, to increase the output dosage over middle-energy and high-energy accelerators and to implement multiple purposes on one machine. The "Image Guided Radiation Treatment" (IGRT) is primary research direction in recent years. The related patents are as below:

1. U.S. Pat. No. 4,286,192 A, Tanabe et al., Varian, August 1981;
2. U.S. Pat. No. 4,382,208 A, Meddaugh et al., Varian, May 1983;
3. U.S. Pat. No. 4,629,938 A, Whitham, Varian, December 1986;
4. U.S. Pat. No. 4,746,839 A, Kazusa et al., NEC, May 1988;
5. U.S. Pat. No. 5,821,694 A, Young, LANL, October 1998;
6. U.S. Pat. No. 6,366,021 B1, Meddaugh et al., Varian, April 2002;
7. PCT/GB00/03004, Allen et al., Elekta, August 2000;
8. CN 1237079 A, TONG Dechun et al., TSINGHUA UNIVERSITY et al., December 1999.

When treading deceases using radiation treatment devices, the high-energy radiation beams radiated by electron linear accelerator are used to kill ill cells such as cancer cells. However, the energy of such radiation beams are much higher than that required by medical imaging. Therefore, what is needed is a device capable of switching between high energy and low energy such that the linear accelerator outputs low-energy electron beams when the radiation treatment device is used for examining, while outputs high-energy electron beams when the device is used for treating.

In the 20 cm beam focus segment in front of the electron linear accelerator, the electrons are accelerated to a velocity very close to the velocity of light (the energy is at about 1-1.5 MeV), in the following light segments the electrons are further accelerated over the wave to a high energy. Finally, the performance of the electron beams is determined by the relationship of field intensity and phase velocity to a great extent. The phase velocity, however, is a structural parameter, while the field intensity is changed over the power. The energy of electrons is decreased over the along with the decrease of power. When the power is decreased to a certain value, the relationship of field intensity and phase velocity in the beam focus segment goes far away from the design value, the performance of electron beam output is seriously deteriorated and trapping is greatly reduced so that the accelerator cannot function normally.

This problem can be avoided by using a phase switch to adjust energy. Assume that the electron beam energy finally output by the accelerator is 18 MeV, a phase switch is placed at a position when the electron energy reaches 12 MeV. When the phase switch is working, the accelerating segments after the switch are phase inversed, i.e., with a change of 180 degree in phase. Then the electrons are decelerated rather than being accelerated, with the energy decreased to 6 MeV from 12 MeV. Since the relationship of the field intensity and phase velocity in these two statuses is not changed, the 6 MeV electron beam has a performance as good as that of the 18 MeV electron beam.

Tanabe taught a design in U.S. Pat. No. 4,268,192 that, in a common side-coupling cavity, an end could be replaced by a movable piston. When the piston is extended into the coupling cavity, the frequency of TM011 or TEM modes is decreased to a value in wave band S and the structure is resonated again. The phases of the accelerating segments after the cavity change 180 degree and implement phase inversion because there's an additional phase movement of $\pi$ in this coupling cavity. However, under this status, the field intensity in the coupling cavity is very high, and any moving components would cause high-frequency fire striking. During phase inversion, it is difficult to adjust field intensity separately. In addition, the structure is not operating in $\pi/2$ mode in this segment. A minor change of the position of the piston would not only affect the resonance capability of the whole structure, but also change the distribution of the field intensity.

In the above patent applications No. U.S. Pat. No. 4,286,192, U.S. Pat. No. 4,382,208, U.S. Pat. No. 4,629,938, and U.S. Pat. No. 6,366,021 obtained by Varian, the patent application No. U.S. Pat. No. 4,629,938 has always been used in the medical use accelerators produced by Varian. The Patent No. CN 1,237,079 A obtained by Tsinghua University is similar to the above patents. The technology of Tsinghua's is used in axis-coupling standing wave structure, while the technologies of Varian's are used in side-coupling standing wave structure. Patent No. U.S. Pat. No. 6,366,021 is the latest one. The above patents are all adjusting mechanisms used in a coupling cavity that adjust the relative field intensity in the previous and next accelerating structures by changing its coupling to the two adjacent accelerating cavities to improve the outputs at low-energy end. Therefore, they are often referred to as "energy switch". The patent by NEC uses two predetermined coupling cavities that have different coupling to adjacent accelerating cavities, and achieves the same by deresonate one of the two cavities. However, all the technologies above improve the performance of the low-energy electron beam outputted by the accelerator by changing coupling coefficients to increase the field intensity of the beam focus segment, while do not incorporate phase inversion. Further discussions are omitted herewith.

The patent application No. PCT/GBOO/03004 by Elekta implements phase inversion by using a cylindrical coupling cavity having an axis perpendicular to the axis of the accelerator (conventionally, the axis of the coupling cavity is in parallel to the axis of the accelerator). The device operates in $TE_{111}$ polarized mode, continuously adjusts its relative coupling to the adjacent accelerating cavities by rotating the polarization plane of the mode with mechanism, and achieves the purpose for phase inversion. However, according to the recitations in the description of this patent application, the frequency of the cylindrical coupling cavity would change when the polarization plane rotates so that the performance of the structure and the stability of operation are affected. Besides, since the device operates under a high order mode $TE_{111}$, it may be easily affected by other adjacent high order modes during operation. Since there's still field intensity existed in the cylindrical coupling cavity, the device is not strictly operating in $\pi/2$ mode and also has the problem of fire striking. All these problems affect the operation stability of the device. In addition, the adjusting in the adjustment mechanism is not convenient, and has a low flexibility.

SUMMARY OF THE INVENTION

To solve the above problems, this invention provides a phase switch capable of simple energy switching and stably operating in $\pi/2$ mode without the problem of accurate positioning of the adjustment mechanism, and a standing wave electron linear accelerator for medical use that is formed by using the phase switch.

According to a first aspect of this invention, a phase switch used for coupling to a standing wave electron linear accelerator with a side-coupling structure is provided. Said accelerator comprises a plurality of accelerating cavities arranged parallel in a line, and is disposed between a predetermined set of two adjacent accelerating cavities in said plurality of accelerating cavities. Said phase switch is constituted by a tri-cavity system and a separate single coupling cavity. Said phase switch operates under a normal status and an inversed status. During the normal status, the tri-cavity system is deresonated, only the single coupling cavity is in operating status, the field in the two accelerating cavities coupling previously and next to said phase switch are both accelerating field. During the inversed status, the single coupling cavity is deresonated, only the tri-cavity system is in operating status, the accelerating cavity coupling previously to said phase switch is an accelerating cavity and the accelerating cavity coupling next to said phase switch is a decelerating cavity. That's to say, when the switch is switching between the two statuses, the phase of the field intensity in the accelerating cavity coupling next to said phase switch has changed $\pi$.

According to a second aspect of this invention, a standing wave electron linear accelerator is provided. The standing wave electron linear accelerator comprises: a plurality of accelerating cavities arranged parallel in a line; and at least one phase switch as above, where the whole structure of the electron linear accelerator including the structure of said phase switch is operating in $\pi/2$ mode.

By using the phase switch and the electron linear accelerator according to this invention, the problems existed in the prior art such as low structure performance and operation stability, fire-striking, low coupling efficiency, low flexibility, and the requirement of accurate positioning reset can be overcome.

DESCRIPTION OF FIGURES

The details of the present invention, both as to its structure and operation, can best be understood in reference to the accompanying drawings, in which like reference numerals refer to like parts, and in which.

DETAILED DESCRIPTION

Figure 1A:
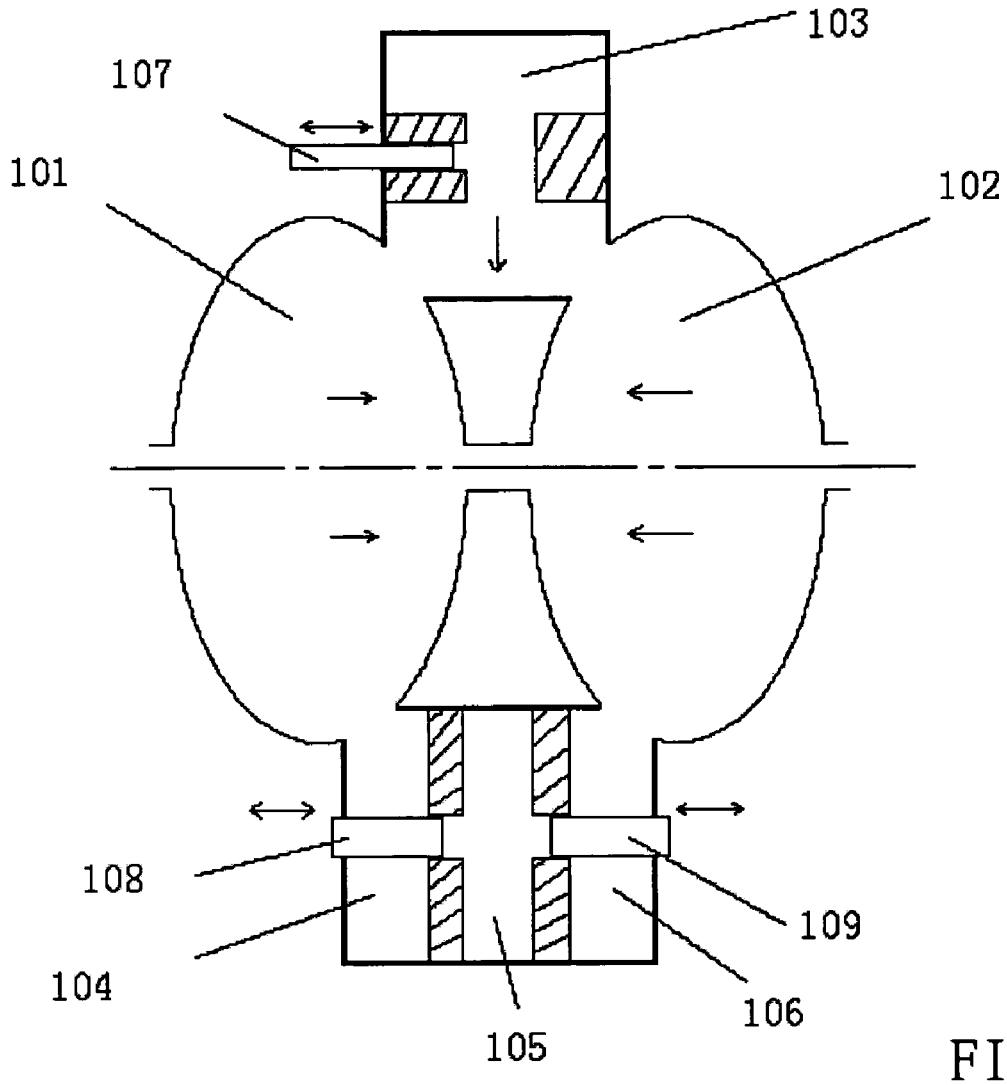
FIGS. 1A and 1B show the structure of a phase switch according to a first embodiment of this invention and its field distribution in its adjacent accelerating cavity, respectively, the phase switch being in a status called normal status "0"
Figure 1B:
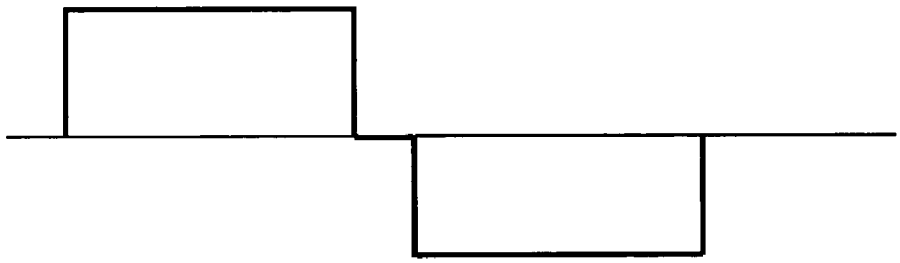

FIGS. 1A and 1B show a status of a phase switch according to the first embodiment of this invention and its field distribution in its adjacent accelerating cavities, respectively, where the status is also referred to as a normal status "0". The electrons meet an accelerating field after it reaches the accelerating cavity right after the phase switch. Numerals 101 and 102 in FIG. 1A refer to accelerating cavities, numeral 103 refers to a single coupling cavity in the phase switch, numerals 104 and 106 refer to end-coupled cavities, numeral 105 refers to side-passed accelerating cavities, numerals 107, 108, 109, and 116 are parts used in a deresonance cavity. Though only two adjacent accelerating cavities 101 and 102 are shown in FIG. 1A, the electron accelerator can include a plurality of (at least two) accelerating cavities having axes therein aligned that are arranged in parallel. The adjacent accelerating cavity 101 and 102 are connected via a coupling unit (i.e., the phase switch composed of a tri-cavity system 104, 105, 106 and a single coupling cavity 103) so that the whole electron accelerating system becomes one part. The coupling between the coupling unit and the accelerating cavities 101, 102 are implemented via coupling slot. Those skilled in the art can easily understand that the coupling unit can be disposed at any position on the side of the adjacent accelerating activities 101, 102, as long as it can connect the adjacent accelerating cavities and conforms to the design requirement of the side coupling structure of the electron accelerator. For example, the coupling unit can be disposed at the top, the bottom or both sides of the adjacent accelerating cavities.

The phase switch according to a first embodiment of this invention is composed of a tri-cavity system (including an end-coupled cavity 104, a side-passed accelerating cavity 105 and an end-coupled cavity 106) and a separate single coupling cavity 103, as shown in FIG. 1A. The tri-cavity system is disposed at the bottom of the accelerating cavity and are arranged in parallel with their axes aligned, where their axes are in parallel to the axes of the accelerating cavities 101, 102. The two end-coupled cavities 104 and 106 are coupled to the accelerating cavities 101 and 102 via two coupling slots thereon, respectively. The single coupling cavity 103 is disposed at the top of the accelerating cavity. Likewise, the single coupling cavity 103 is coupled to the accelerating cavities 101 and 102 via the two coupling slots thereon, respectively. The axis of the single coupling cavity 103 is in parallel to those of the accelerating cavities 101, 102.

The phase switch according to this invention has two statuses. FIG. 1A shows a status "0", where the tri-cavity system is deresonated, the single coupling cavity 103 is working.

FIG. 1A shows a status of the phase switch, i.e., normal status "0". On the two end-coupled cavities 104 and 106, deresonance parts 108 and 109 are respectively disposed at a side opposite to the side-passed accelerating cavity 105, while the movement direction (move in or move out) of the deresonance parts 108 and 109 are in parallel to the axis of the accelerating cavity. Likewise, a deresonance part 107 is disposed on each side of the single coupling cavity 103 that is perpendicular to the axis of the accelerator. As shown, when the deresonance parts 108 and 109 are moved into the cavity, the tri-cavity system is deresonated entirely, at the same time the deresonance part 107 in the single coupling cavity 103 is entirely moved outside the cavity. The whole structure accelerates the electrons to high energy like a common accelerating structure. At this time, the single coupling cavity is working, while no part is contacted therein and there is no radio frequency break down. There's no radio frequency break down in tri-cavity system either because the field in the tri-cavity system is very weak.

Figure 2A:
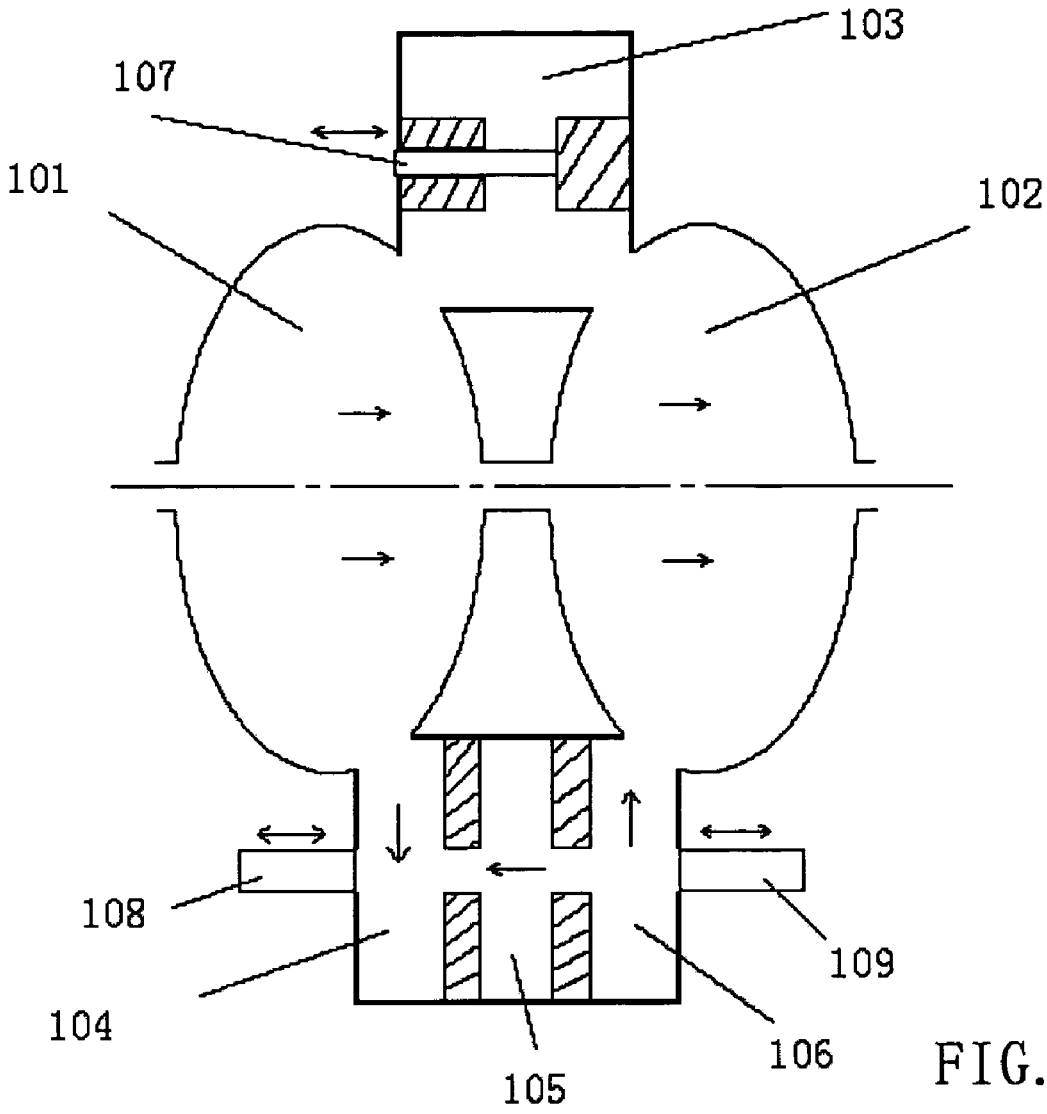
FIGS. 2A and 2B show the structure of a phase switch according to a first embodiment of this invention and its field distribution in its adjacent accelerating cavity, respectively, the phase switch being in another status called inversion status "1"
Figure 2B:
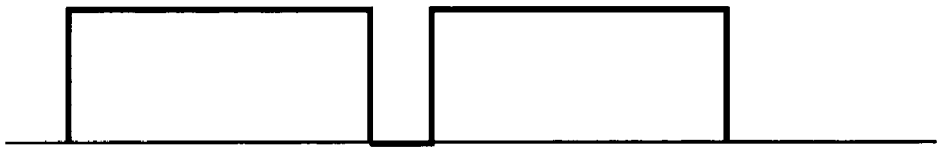

FIG. 2A shows another status of the phase switch, i.e., inversion status "1". When the system is in status "1", the tri-cavity system is working, while the single coupling cavity 103 is deresonated. At this time, the deresonance parts are entirely moved into the cavity, the single coupling cavity is entirely deresonated while the tri-cavity system is working. The radio frequency field moved from the accelerating cavity 101 to a next accelerating cavity 102 via the tri-cavity system. Since the tri-cavity system is also operating in $\pi/2$ mode, an additional phase movement of $\pi$ is introduced. The phase of the field in the following accelerating segments are inversed (relative to normal status "0"), and the electrons are decelerated therein. When the system is symmetrically designed, whether in normal status "0" or inversion status "1", the field intensity at both sides of the system are equal, as shown in the field distribution in FIGS. 1B and 2B. It should be noted that the field distribution in the figures are the field distribution and field direction in the accelerating cavity at a moment, rather than the field met by the electrons in each cavity. Specifically, for example as in FIG. 1A, though the field directions in the two accelerating cavities are shown as opposite, the fields met by the electrons in the accelerating cavity 101 and the accelerating cavity 102 are identical, i.e., both are accelerating fields, because the field direction in accelerating cavity 102 has changed $\pi$ degree when the electrons travels from the accelerating cavity 101 to the accelerating cavity 102.

When the switch switches between the two statuses, the phase of the field in the accelerating segments after the phase switch would be changed. When the switch is operating under each of the two statuses, the whole structure is operating in $\pi/2$ mode. Therefore, under any of the status, the accelerator can function stably, which is especially important to the accelerators for medical use. The above patent application U.S. Pat. No. 4,286,192 A and PCT/GBOO/03004 cannot achieve such functions. Besides, the switching of the switch from one position to another position does not require accurate positioning, as the above two patents require, since the function of the converting mechanism in this invention (i.e., the deresonance parts 107-109) are just to deresonate the single couple cavity or the tri-cavity system.

We apply this phase switch on a common 6 MeV short accelerator. After preadjusting the structure parameters, an interesting set of results are obtained as below:

| Status | Trapping (%) | Center Energy of the Beam (KeV) | Electons at 7% of the Energy |
|---|---|---|---|
| Power 1 | 22 | 173 | 40 |
| Power 2 | 21 | 133 | 31 |
| Power 3 | 17 | 88 | 30 |

Since the magnetron is working at a low power status, the repetition frequency can be greatly improved and the output can be increased for imaging application. This result has provided a promising future. By using this invention, i.e., the phase switch described in this application, a standing wave accelerating tube with a length of 30 cm is fabricated. By using a 2.6 Mw magnetron, a 6 MeV electron beam is outputted for use of treatment when the phase switch is in normal status "0", while a 100-150 KeV electron beam is outputted for use of imaging application when the phase switch is switched to inversion status "1". The target spots of the two sources are almost in the same position so that a real "Image Guided Radiation Treatment" (IGRT) is implemented and a revolution in radiation treatment is introduced.

Figure 3A:
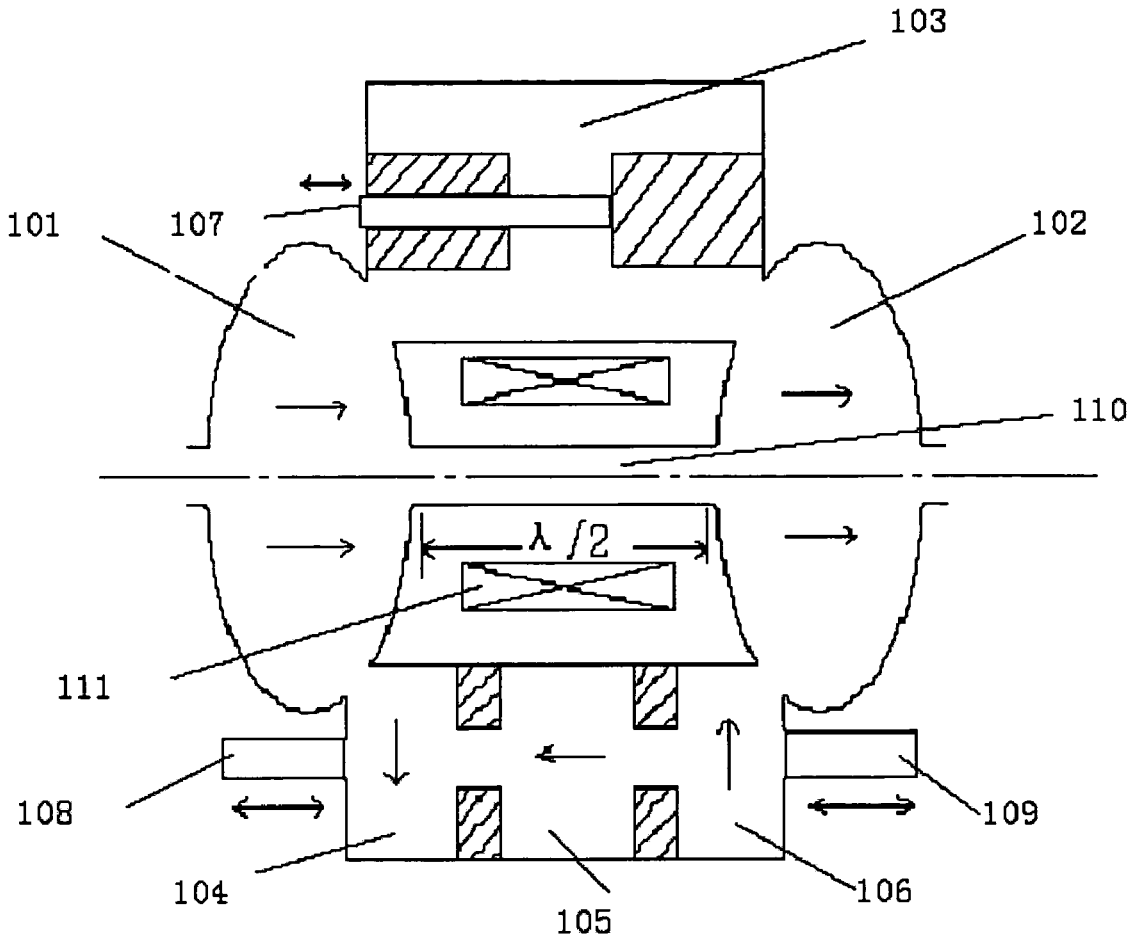
FIGS. 3A and 3B show another arrangements of a phase switch according to a second embodiment of this invention and its field distribution in the accelerating cavity, respectively, this arrangements being especially suitable for the accelerators in wave band x.

FIG. 3A shows another arrangement of a phase switch according to a second embodiment of this invention. This arrangement is especially suitable for the accelerators in wave band x. Like parts in FIG. 3A are referenced by use of the same reference numerals as in FIG. 1A. Further, numeral 110 refers to a drift space, numeral 111 refers to a focus or deflection element. In general, the energy of electrons at the position of phase switch is already very high. A drift space 110 with a length of $\lambda/2$ can be disposed. A focus or deflection element 111 can be disposed as desired in the drift space. This kind of arrangement can provide more vertical spaces for the phase switch. For the phase switch, the two arrangements have no difference. But for the operation of the accelerator, the functions of the two status of the phase switch would be exactly reversed. This kind of arrangement is especially suitable for the accelerators in wave band x. The length of the drift space can also be increased to $\lambda$, $3\lambda/2$. . .

Figure 3B:
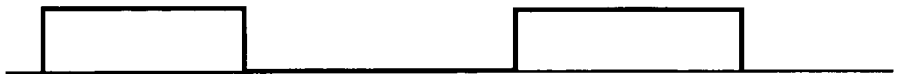

FIG. 3B shows the field intensity distribution in another arrangement of the phase switch according to a second embodiment of this invention.

Figure 4A:
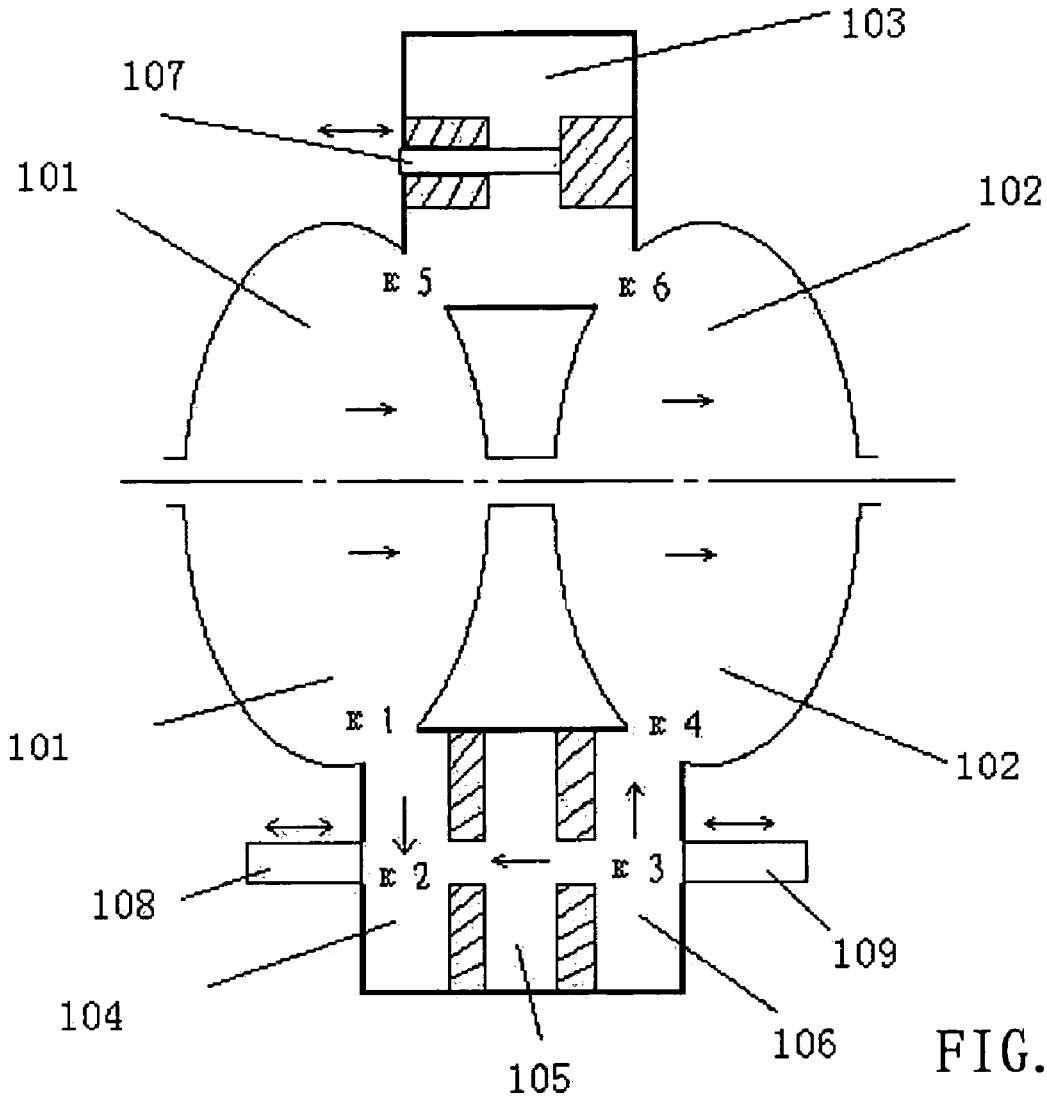
FIGS. 4A and 4B show a phase switch according to a third embodiment of this invention and its field distribution in the accelerating cavity, respectively.
Figure 4B:
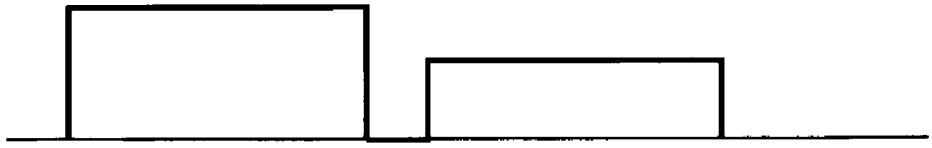

FIG. 4A shows a phase switch according to a third embodiment of this invention. Assuming that k1 is the coupling coefficient of the accelerating cavity 101 and the end-coupled cavity 102 in the phase switch, k2 is the coupling coefficient of the end-coupled cavity 104 and side-passed accelerating cavity 105, k3 is the coupling coefficient of the side-passed accelerating cavity 105 and the end-coupled cavity 106, k4 is the coupling coefficient of the end-coupled cavity 106 and the accelerating cavity 102, k5 is the coupling coefficient of the accelerating cavity 101 and the single coupling cavity 103 in the phase switch, and k6 is the coupling coefficient of the single coupling cavity 103 and the accelerating cavity 102. When it is required to asymmetrically design the phase switch, for example, k4 is greater than k1, then the field intensity of the following accelerating segments are decreased when the phase is inversed. Referring back to the arrangements in FIGS. 1A and 2A. As mentioned before, when the system is symmetrically designed, i.e., the embodiments of FIGS. 1A and 2A, the coupling coefficients meet: k1=k4, k2=k3, and k5=k6. Whether in normal status "0" or inversion status "1", the field intensity at both sides of the system (accelerating cavities 101 and 102 in this invention) remain the same. When the tri-cavity system is asymmetrically designed, the field intensity in the following accelerating segments can be increased or decreased according to the design requirements when the phase is inversed. For example, if k4 is greater than k1, and k2 equals to k3, then the field intensity in the following accelerating segments will be decreased when the phase is inversed, as shown in the field intensity distribution in FIG. 4B. However, k5 and k6 can be changed in the arrangement of FIG. 3A. For example, if k6 is greater than k5, the field intensity in the following accelerating segments will be decreased when the phase is inversed. Since there are four parameters (k1, k2, k3, and k4) that can be adjusted, the range of field intensity adjustments would be quite large. Please note that the two functions of the phase switch, that is, phase change $\pi$ and field intensity adjustments, are entirely independent. Whether the field intensity in the following accelerating segments increases or decreases, the structure is always operating in $\pi/2$ mode.

Figure 5B:
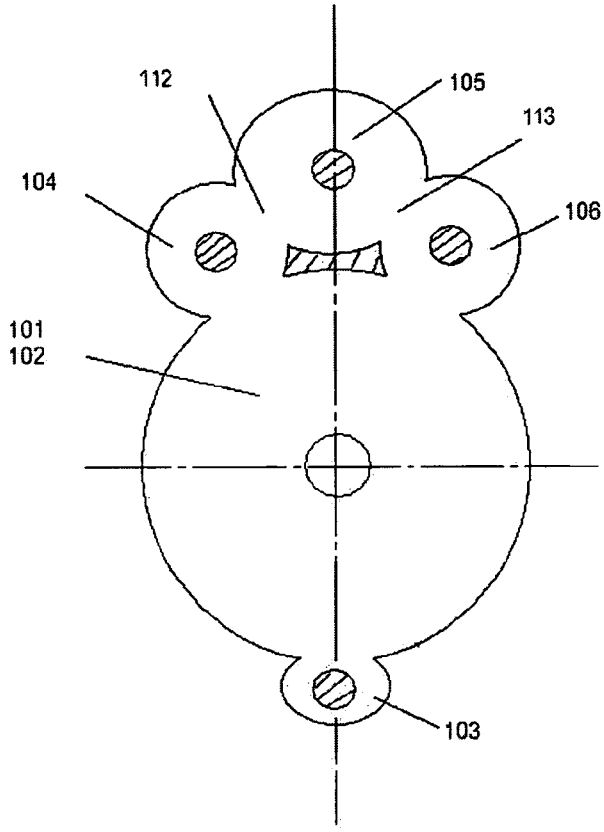
FIGS. 5A and 5B show a phase switch according to a fourth embodiment of this invention.
Figure 5A:
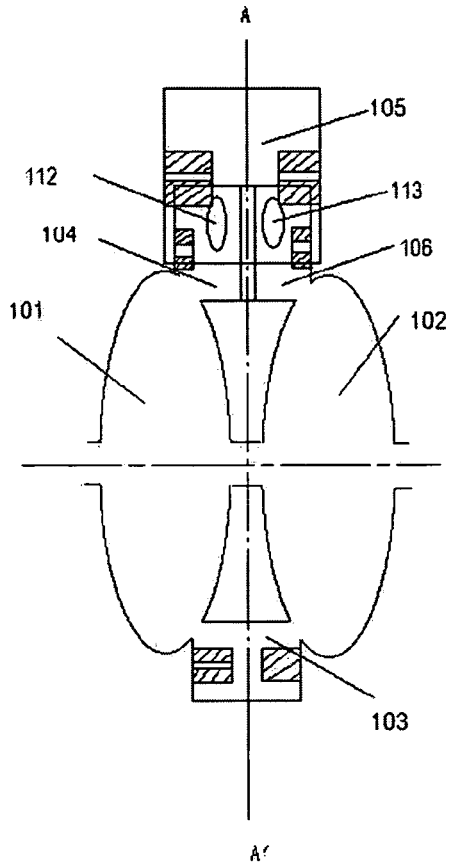
Figure 6:
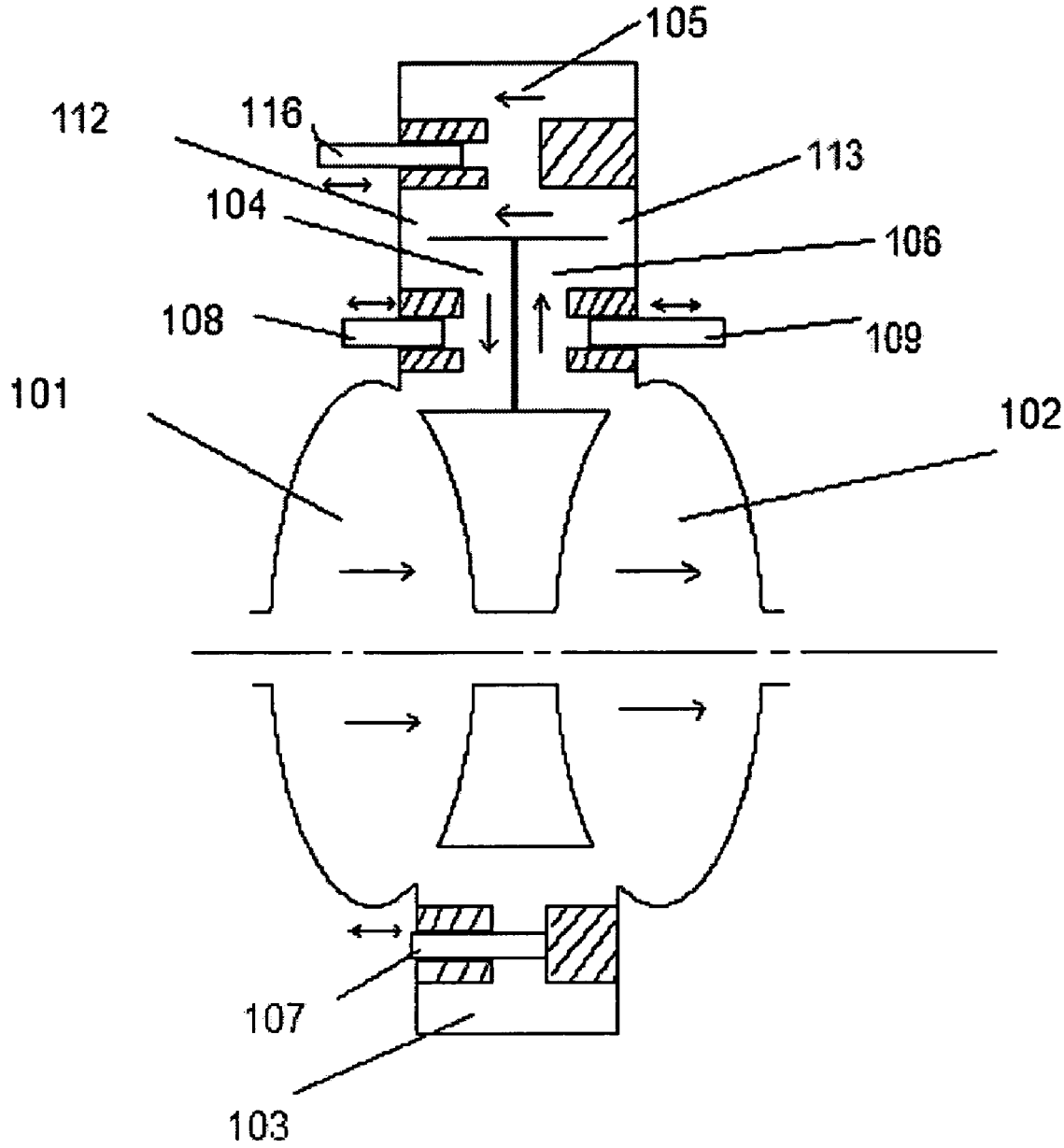
FIG. 6 shows a phase switch according to a fifth embodiment of this invention.

FIGS. 5 and 6 show a phase switch according to a fourth and a fifth embodiment of this invention, respectively. Numeral 112 refers to the coupling slot between the end-coupled cavity 104 and the side-passed accelerating cavity 105 in the phase switch, and numeral 113 refers to the coupling slot between the side-passed accelerating cavity 105 and the end-coupled cavity 106 in the phase switch. For utilizing the limited vertical spaces more efficiently, appropriate changes could be made to the arrangement of the tri-cavity system. FIGS. 5 and 6 show two different embodiments.

FIG. 5 shows an arrangement of this invention that is closer to the practical use. FIG. 5A is a side view of the fourth embodiment of this invention, while FIG. 5B is a cutaway view along the dotdash line AA'. For conciseness, parts used for deresonance cavity are not shown in FIGS. 5A and 5B. In the embodiment shown in FIGS. 5A and 5B, the tri-cavity system is disposed on the tope of the accelerating cavities 101 and 102, while the single coupling cavity 103 is disposed at the bottom of the accelerating cavities 101 and 102. The tri-cavity system in this embodiment has different arrangements than that in the first embodiment. As shown, the axis of the side-passed accelerating cavity 105 in the tri-cavity system is disposed at a plane that is a little higher than the axes of the two end-coupled cavities 104 and 106, while the two end-coupled cavities 104 and 106 are staggered a certain angle with an axis of the accelerating cavity as the axis. As for the height of the axis of side-passed accelerating cavity 105 over the end-coupled cavities 104 and 106 and the angle staggered by the two end-coupled cavities 104 and 106, they can be designed and selected by those skilled in the art based on the specific applications.

In the fifth embodiment shown in FIG. 6, similar to the fourth embodiment, the tri-cavity system is disposed on the top of the accelerating cavities 101 and 102, while the single coupling cavity 103 is disposed at the bottom of the accelerating cavities 101 and 102. However, the tri-cavity system in this embodiment has different arrangements than that in the first embodiment. As shown, the axis of the side-passed accelerating cavity 105 in the tri-cavity system is disposed at a plane that is a little higher than the axes of the two end-coupled cavities 104 and 106, and the side-passed accelerating cavity 105 is coupled to the end-coupled cavities 104 and 106 via the coupling slots 112 and 113 that are disposed at their bottom surfaces rather than side surfaces. Besides, an additional deresonance part 116 is provided for deresonating the side-passed accelerating cavity 105.

By such changes in the arrangements, the practical effects of this invention would not be affected, and the purpose of efficient utilization of the spaces can be achieved. Other arrangements can be easily contemplated and can be covered by this invention without going beyond the general principle of this invention.

This phase switch can also be applied in axis coupling standing wave structure. The forgoing description of an implementation of the invention has been presented for purposes of illustration and description. It is not exhaustive and does not limit the invention to the precise disclosure. Modifications and variations are possible in light of the above teachings or may be acquired from practicing of the invention.

The invention claimed is:

1. A phase switch for coupling to a standing wave electron linear accelerator via a side coupling structure, said accelerator including a plurality of accelerating cavities arranged parallel in a line, said phase switch disposed between a predetermined set of two adjacent accelerating cavities in said plurality of accelerating cavities, wherein:

said phase switch being composed by a tri-cavity system and a separate single coupling cavity;

said phase switch operating in normal status and inversion status, when in normal status, said tri-cavity system being deresonated while said single couple cavity being in operation status, the fields in the two accelerating cavities coupling previously and next to said phase switch both being accelerating fields; when in inversion status, only said tri-cavity system being in operation status, the field in the accelerating cavity coupling previously to said phase switch being an accelerating field while the field in the accelerating cavity coupling next to said phase switch being an decelerating field; when the switch switching between the two status, the field intensity of the accelerating cavity coupling next to said phase switch has a phase change of $\pi$; and wherein said single coupling cavity further comprising a deresonance part for deresonance, and a first coupling slot and a second coupling slot respectively coupling to said two adjacent accelerating cavities of the electron accelerator.

2. The phase switch as claimed in claim 1, wherein said tri-cavity system being disposed at the bottom of said accelerating cavity while said single coupling cavity being disposed on the top of said accelerating cavity.

3. The phase switch as claimed in claim 1, wherein said tri-cavity system being disposed on the top of said accelerating cavity while said single coupling cavity being disposed at the bottom of said accelerating cavity.

4. The phase switch as claimed in claim 1, wherein said tri-cavity system further comprising a first end-coupled cavity, a second end-coupled cavity, and a side-passed accelerating cavity:

said first end-coupled cavity having a third coupling slot used for coupling to a first accelerating cavity in said two adjacent accelerating cavities that are coupled to said phase switch, and a second deresonance part used for deresonating said first end-coupled cavity and side-passed accelerating cavity;

said second end-coupled cavity having a fourth coupling slot used for coupling to a second accelerating cavity in said two adjacent accelerating cavities that are coupled to said phase switch, and a third deresonance part used for deresonating said second end-coupled cavity and side-passed accelerating cavity;

the side-passed accelerating cavity being disposed between the first end-coupled cavity and the second end-coupled cavity, said side-passed accelerating cavity having a fifth coupling slot and a fifth coupling slot respectively coupling to said first end-coupled cavity and said second coupling cavity.

5. The phase switch as claimed in claim 4, wherein, said first end-coupled cavity and said second end-coupled cavity being arranged parallel in a manner that their axes being aligned, where their axis is in parallel to the axis of said accelerating cavity;

the axis of said single coupling cavity being in parallel to the axis of said accelerating cavity.

6. The phase switch as claimed in claim 4, wherein the axis of said side-passed accelerating cavity being disposed at a plane that is a little higher than the axes of said first end-coupled cavity and said second end-coupled cavity, while said first end-coupled cavity and said second end-coupled cavity being staggered a certain angle with an axis of the accelerating cavity as the axis.

7. The phase switch as claimed in claim 4, wherein said side-passed accelerating cavity being disposed above said first end-coupled cavity and said second end-coupled cavity, said fifth and sixth coupling slots being disposed at the bottom of said side-passed accelerating cavity, said side-passed accelerating cavity further comprising a fourth deresonance part for deresonance.

8. The phase switch as claimed in claim 4, wherein, during the phase inversion, the coupling coefficients between said first end-coupled cavity, said second end-coupled cavity and said side-passed accelerating cavity in said phase switch and the coupling coefficients between said first and second end-coupled cavities and their respective adjacent accelerating cavity are variable, for changing the relative field intensity in its previous and next segments.

9. A standing wave electron linear accelerator, comprising:

a plurality of accelerating cavities arranged parallel in a line; and at least one said phase switch for coupling to a standing wave electron linear accelerator via a side coupling structure, said accelerator including the plurality of accelerating cavities arranged parallel in a line, said phase switch disposed between a predetermined set of two adjacent accelerating cavities in said plurality of accelerating cavities, wherein:

said phase switch being composed by a tri-cavity system and a separate single coupling cavity;

said phase switch operating in normal status and inversion status, when in normal status, said tri-cavity system being deresonated while said single couple cavity being in operation status, the fields in the two accelerating cavities coupling previously and next to said phase switch both being accelerating fields; when in inversion status, only said tri-cavity system being in operation status, the field in the accelerating cavity coupling previously to said phase switch being an accelerating field while the field in the accelerating cavity coupling next to said phase switch being an decelerating field; when the switch switching between the two status, the field intensity of the accelerating cavity coupling next to said phase switch has a phase change of $\pi$; and wherein said single coupling cavity further comprising a deresonance part for deresonance, and a first coupling slot and a second coupling slot respectively coupling to said two adjacent accelerating cavities of the electron accelerator;

wherein the whole structure of said electron linear accelerator, including the structure of said phase switch, operating in $\pi/2$ mode.

10. A phase switch for coupling to a standing wave electron linear accelerator via a side coupling structure, said accelerator including a plurality of accelerating cavities arranged parallel in a line, said phase switch disposed between a predetermined set of two adjacent accelerating cavities in said plurality of accelerating cavities, wherein:

said phase switch being composed by a tri-cavity system and a separate single coupling cavity;

said phase switch operating in normal status and inversion status, when in normal status, said tri-cavity system being deresonated while said single couple cavity being in operation status, the fields in the two accelerating cavities coupling previously and next to said phase switch both being accelerating fields; when in inversion status, only said tri-cavity system being in operation status, the field in the accelerating cavity coupling previously to said phase switch being an accelerating field while the field in the accelerating cavity coupling next to said phase switch being an decelerating field; when the switch switching between the two status, the field intensity of the accelerating cavity coupling next to said phase switch has a phase change of $\pi$; and wherein:

said tri-cavity system further comprising a first end-coupled cavity, a second end-coupled cavity, and a side-passed accelerating cavity:

said first end-coupled cavity having a first coupling slot used for coupling to a first accelerating cavity in said two adjacent accelerating cavities that are coupled to said phase switch, and a first deresonance part used for deresonating said first end-coupled cavity and side-passed accelerating cavity;

said second end-coupled cavity having a second coupling slot used for coupling to a second accelerating cavity in said two adjacent accelerating cavities that are coupled to said phase switch, and a second deresonance part used for deresonating said second end-coupled cavity and side-passed accelerating cavity; and the side-passed accelerating cavity being disposed between the first end-coupled cavity and the second end-coupled cavity, said side-passed accelerating cavity having a third coupling slot and a fourth coupling slot respectively coupling to said first end-coupled cavity and said second coupling cavity.

11. The phase switch as claimed in claim 10, wherein said tri-cavity system being disposed at the bottom of said accelerating cavity while said single coupling cavity being disposed on the top of said accelerating cavity.

12. The phase switch as claimed in claim 10, wherein said tri-cavity system being disposed on the top of said accelerating cavity while said single coupling cavity being disposed at the bottom of said accelerating cavity.

13. The phase switch as claimed in claim 10, wherein, said first end-coupled cavity and said second end-coupled cavity being arranged parallel in a manner that their axes being aligned, where their axis is in parallel to the axis of said accelerating cavity;

the axis of said single coupling cavity being in parallel to the axis of said accelerating cavity.

14. The phase switch as claimed in claim 10, wherein the axis of said side-passed accelerating cavity being disposed at a plane that is a little higher than the axes of said first end-coupled cavity and said second end-coupled cavity, while said first end-coupled cavity and said second end-coupled cavity being staggered a certain angle with an axis of the accelerating cavity as the axis.

15. The phase switch as claimed in claim 10, wherein said side-passed accelerating cavity being disposed above said first end-coupled cavity and said second end-coupled cavity, said fifth and sixth coupling slots being disposed at the bottom of said side-passed accelerating cavity, said side-passed accelerating cavity further comprising a fourth deresonance part for deresonance.

16. The phase switch as claimed in claim 10, wherein, during the phase inversion, the coupling coefficients between said first end-coupled cavity, said second end-coupled cavity and said side-passed accelerating cavity in said phase switch and the coupling coefficients between said first and second end-coupled cavities and their respective adjacent accelerating cavity are variable, for changing the relative field intensity in its previous and next segments.

17. A standing wave electron linear accelerator, comprising:

a plurality of accelerating cavities arranged parallel in a line;

at least one said phase switch for coupling to a standing wave electron linear accelerator via a side coupling structure, said accelerator including a plurality of accelerating cavities arranged parallel in a line, said phase switch disposed between a predetermined set of two adjacent accelerating cavities in said plurality of accelerating cavities, wherein:

said phase switch being composed by a tri-cavity system and a separate single coupling cavity;

said phase switch operating in normal status and inversion status, when in normal status, said tri-cavity system being deresonated while said single couple cavity being in operation status, the fields in the two accelerating cavities coupling previously and next to said phase switch both being accelerating fields; when in inversion status, only said tri-cavity system being in operation status, the field in the accelerating cavity coupling previously to said phase switch being an accelerating field while the field in the accelerating cavity coupling next to said phase switch being an decelerating field; when the switch switching between the two status, the field intensity of the accelerating cavity coupling next to said phase switch has a phase change of $\pi$; and wherein:

said tri-cavity system further comprising a first end-coupled cavity, a second end-coupled cavity, and a side-passed accelerating cavity:

said first end-coupled cavity having a first coupling slot used for coupling to a first accelerating cavity in said two adjacent accelerating cavities that are coupled to said phase switch, and a first deresonance part used for deresonating said first end-coupled cavity and side-passed accelerating cavity;

said second end-coupled cavity having a second coupling slot used for coupling to a second accelerating cavity in said two adjacent accelerating cavities that are coupled to said phase switch, and a second deresonance part used for deresonating said second end-coupled cavity and side-passed accelerating cavity; and the side-passed accelerating cavity being disposed between the first end-coupled cavity and the second end-coupled cavity, said side-passed accelerating cavity having a third coupling slot and a fourth coupling slot respectively coupling to said first end-coupled cavity and said second coupling cavity; and wherein the whole structure of said electron linear accelerator, including the structure of said phase switch, operating in $\pi/2$ mode.

* * * * *